US010919689B2

(12) United States Patent
Cailleaux et al.

(10) Patent No.: US 10,919,689 B2
(45) Date of Patent: Feb. 16, 2021

(54) MODIFIED CONTAINER OF CONSUMER ARTICLES COMPRISING AN ELEMENT OF DISCERNIBLE THICKNESS

(71) Applicant: PHILIP MORRIS PRODUCTS S.A., Neuchatel (CH)

(72) Inventors: Timothee Cailleaux, Divonne-les-Bains (FR); David Pitton, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 10 days.

(21) Appl. No.: 16/319,635

(22) PCT Filed: Jul. 24, 2017

(86) PCT No.: PCT/EP2017/068679
§ 371 (c)(1),
(2) Date: Jan. 22, 2019

(87) PCT Pub. No.: WO2018/019787
PCT Pub. Date: Feb. 1, 2018

(65) Prior Publication Data

US 2020/0223618 A1 Jul. 16, 2020

(30) Foreign Application Priority Data

Jul. 27, 2016 (EP) ..... 16181559

(51) Int. Cl.
*B65D 85/10* (2006.01)

(52) U.S. Cl.
CPC ..... *B65D 85/1045* (2013.01); *B65D 85/1081* (2013.01)

(58) Field of Classification Search
CPC ..... B65D 5/42; B65D 5/441; B65D 5/445; B65D 85/10; B65D 85/1045; B65D 85/1081
(Continued)

(56) References Cited

U.S. PATENT DOCUMENTS 1,698,699 A * 1/1929 Andrews ..... B65D 5/441 229/182
2,745,591 A * 5/1956 Holt, Jr. ..... B65D 5/445 229/198.1
(Continued)

FOREIGN PATENT DOCUMENTS

CN 1791881 6/2006
CN 101052975 10/2007
(Continued)

OTHER PUBLICATIONS

PCT Search Report and Written Opinion for PCT/EP2017/068679 dated Nov. 15, 2017 (8 pages).
(Continued)

*Primary Examiner* — Bryon P Gehman
(74) *Attorney, Agent, or Firm* — Mueting Raasch Group

(57) ABSTRACT

A container for consumer goods is formed from a laminar blank (100, 300) having a blank thickness (T1) and comprises a three dimensional element (104, 304) having a thickness (T2) from about 50 micrometres to about 500 micrometres. The element (104, 304) is affixed to the container by means of adhesive provided on an affixing area (106) of an inner surface (108) of a first wall of the container. The container comprises a thickness compensating means (112, 312) provided in its entirety on a region of the inner surface of the container other than the affixing area.

15 Claims, 2 Drawing Sheets

(58) Field of Classification Search
USPC ..... 206/271–275; 229/5.81, 199; 428/34.2
See application file for complete search history.

(56) References Cited

U.S. PATENT DOCUMENTS

| | | | | |
|---|---|---|---|---|
| 3,197,113 | A * | 7/1965 | Griese | B65D 5/48048 229/199 |
| 3,355,081 | A * | 11/1967 | Kachurchak | B65D 5/445 229/126 |
| 4,034,909 | A * | 7/1977 | Toda | B65D 5/42 229/199 |
| 5,964,345 | A * | 10/1999 | Gamberini | B65D 85/1045 206/259 |
| 6,591,981 | B2 * | 7/2003 | Draghetti | B65D 85/1081 206/247 |
| 7,847,695 | B2 | 12/2010 | Ficker et al. | |
| 9,449,264 | B1 | 9/2016 | Gordon | |
| 2004/0149602 | A1 | 8/2004 | Draghetti | |
| 2009/0302972 | A1 | 12/2009 | Osamura | |
| 2013/0155715 | A1 | 6/2013 | Kim | |
| 2015/0259132 | A1 | 9/2015 | Bernardo | |
| 2020/0140163 | A1 * | 5/2020 | Novak | B65D 55/028 |

FOREIGN PATENT DOCUMENTS

| | | |
|---|---|---|
| CN | 201249952 | 6/2009 |
| CN | 202144318 | 2/2012 |
| CN | 203079018 U | 7/2013 |
| DE | 102013112279 | 5/2014 |
| EP | 1422168 | 5/2004 |
| RU | 107131 U | 8/2011 |
| WO | WO 2014/167309 | 10/2014 |

OTHER PUBLICATIONS

Office Action issued in Europe for Application No. 17751290.2 dated Aug. 19, 2020 (4 pages).
Office Action issued in Russia for Application No. 2019103840 dated Sep. 17, 2020 (16 pages). English translation included.
Office Action issued in China for Application No. 201780043075.X dated May 28, 2020 (14 pages). English translation included.

* cited by examiner

MODIFIED CONTAINER OF CONSUMER ARTICLES COMPRISING AN ELEMENT OF DISCERNIBLE THICKNESS

This application is a U.S. National Stage Application of International Application No. PCT/EP2017/068679 filed Jul. 24, 2017, which was published in English on Feb. 1, 2018, as International Publication No. WO 2018/019787 A1. International Application No. PCT/EP2017/068679 claims priority to European Application No. 16181559.2 filed Jul. 27, 2016.

The present invention relates to a container for consumer goods formed by folding a laminar blank comprising an additional element having a discernible thickness affixed to a surface of the container. The expression "element having a discernible thickness" is used herein to refer to any three-dimensional element having a thickness from about 50 micrometres to about 500 micrometres. An example of one such element is a radio frequency identification (RFID) element. The container of the present invention finds particular application as a container for elongate consumer good items, such as smoking articles.

Smoking articles are typically packaged in rigid hinge-lid containers comprising a box and a lid hinged to the box along a hinge line extending across a back wall of the container. The bundle of smoking articles housed in the box is commonly wrapped in an inner liner, or package, of metallised paper, metal foil or other flexible sheet material. Both hinge-lid container and inner package are formed from blanks. During transportation, as well as when they are supplied to packing machines, blanks are preferably stacked on top of each other and in a flat state.

Such containers often comprise a reinforcing member, which may be provided as an inner frame arranged outside the inner package or as a stiffener arranged inside the inner package. This is to improve the resistance to compression of the package with a view to better protecting the smoking articles within the container during transportation. In addition, one such hinge lid container may comprise an inner frame extending at least partly beyond an upper edge of the front wall of the box to provide a flat surface which the lid front wall may lie against, when in the closed position. This is generally desirable because, when the lid is in the closed position, a container provided with one such arrangement will present to the consumer a substantially flat front surface. The reinforcing member typically comprises at least a reinforcing front wall lying against a front wall of the inner package. Most commonly, one such reinforcing member is provided as a collar further comprising side walls depending from the reinforcing front wall and folded about respective fold lines to lie against the side walls of the inner package. Thus, in use, one such reinforcing member embraces the bundle of smoking articles on three sides.

Radio frequency elements are known for allowing large amounts of information to be accessed without the need for the information to be printed. Accordingly, it would be desirable to provide a container for consumer articles comprising a radio frequency element, especially such that the radio frequency element is not visible on the external surface of the container, since this space may be better spent on branding or other printed information. However, the provision of an element with a discernible thickness on a blank for forming a container of the type described above may impact the pliability of the blank. In turn, this may undesirably increase the complexity of the manufacturing process.

Further, because the presence of an element with a discernible thickness will locally increase the thickness of the laminar blank from which the container is formed, stacking blanks on top of one another may become less easy if blanks comprise one such element. This may cause problems during the storage and transportation of the blanks, as well as when blanks are fed at high speed to a packing machine for forming the container.

Thus, it would be desirable to provide a novel and improved container for consumer goods comprising an element having a discernible thickness. In particular, it would be desirable for such container to ensure that the consumer articles held within the container are effectively protected from potentially damaging compressive loads. Further, it would be desirable to provide a blank for forming one such container, such that a plurality of said blanks can easily be stacked, palletised, transported and fed to a packing machine to form the container. In addition, it would be desirable to provide one such container for consumer goods that can easily be manufactured without requiring major modifications to existing equipment.

According to an aspect of the present invention, there is provided a container for consumer goods, the container being formed from a laminar blank having a blank thickness. The container comprises a three dimensional element having a thickness from about 50 micrometres to about 500 micrometres, wherein the element is affixed to the container by means of adhesive provided on an affixing area of an inner surface of a first wall of the container. Further, the container comprises a thickness compensating means on a region of the inner surface of the container other than the affixing area.

According to another aspect of the present invention, there is provided a blank for forming a container for consumer goods, the blank comprising: a laminar substrate having a substrate thickness; and a three dimensional element having a thickness from about 50 micrometres to about 500 micrometres, the element being affixed to the laminar substrate. The element is affixed to the container by means of adhesive provided on an affixing area of a first surface of the laminar substrate. In addition, the blank comprises a thickness compensating means on a region of the first surface of the laminar substrate other than the affixing area.

It will be appreciated that any features described with reference to one aspect of the present invention are equally applicable to any other aspect of the invention.

As used herein, the terms "front", "back", "upper", "lower", "top", "bottom" and "side", refer to the relative positions of portions of containers according to the invention and components thereof when the container is in an upright position an access opening of the container at the top of the container. When describing containers according to the present invention, these terms are used irrespective of the orientation of the container being described. The back wall of the outer hinge-lid housing is the wall comprising the hinge line.

When describing a container in accordance with the present invention, the term "longitudinal" refers to a direction from bottom to top or vice versa, whereas the term "transverse" refers to a direction perpendicular to the longitudinal direction. For example, a "longitudinal axis of the container" is an axis extending from bottom to top or vice versa.

The term "width" is used to describe the dimension of an element, such as a radio frequency element or a panel of a blank or a wall of a container as measured in the transverse direction. The term "panel" is used throughout this specification to refer to a portion of the blank that is used to form a wall in the assembled container. A panel may depend along one or more fold lines from one or more other panels. The term "fold line" refers to a fold between two adjacent panels. When forming the container, adjacent panels are folded along their common fold line, which may come to define an edge of the container or of a portion thereof. In the assembled container a "wall" may be formed of one or of several overlying panels that are attached to each other, for example by means of an adhesive. Further, a wall may be formed from two or more abutting or overlapping panels.

The term "height" is used to describe the dimension of one such element as measured in a direction perpendicular to the width of the element. When describing an element of the container, reference is generally made to the element in a flat state.

In a blank for forming a container in accordance with the present invention, the term "longitudinal axis" is used to identify an axis of the blank extending across the blank in a flat state in a direction substantially parallel to the longitudinal direction in the assembled container. Thus, for example, the longitudinal axis of the blank extends across the blank front panel in a direction parallel to the longitudinal direction taken with reference to the corresponding container front wall. The term "transverse axis", on the other hand, is used to identify an axis of the blank extending across the blank in a flat state in a direction perpendicular to the longitudinal axis.

One such blank has a "longitudinal dimension" corresponding to the maximum distance between opposite ends of the blank as measured along the longitudinal axis. Further, one such panel has a "transverse dimension" corresponding to the maximum distance between opposite ends of the blank as measured along a direction perpendicular to the longitudinal axis.

In a rectangle, the longitudinal dimension and the transverse direction will generally correspond to height and width of the rectangle. However, a blank for forming a substantially parallelepiped container for consumer articles will typically have a roughly quadrilateral shape, but may generally not display quite the exact symmetry of a regular rectangle. Accordingly, the terms "longitudinal dimension" and "transverse dimension" are used herein to identify the dimensions of a blank, particularly a substantially quadrilateral blank, which would correspond to height and width of the blank, if the blank were exactly rectangular. The term "midpoint of the longitudinal axis" is used herein to identify the middle point of the longitudinal axis of a blank for forming a container in accordance with the invention, that is, a point that is equidistant from both endpoints of the longitudinal axis. The endpoints of the longitudinal axis of one such blank are on opposite edges of the blank separated by a distance corresponding to the longitudinal dimension of the blank. The midpoint of the longitudinal axis bisects the longitudinal axis, and so the distance between the midpoint and either endpoint of the longitudinal axis is substantially half the longitudinal dimension of the blank.

The term "affixing area" is used herein to refer to the minimum area of the blank that encloses the perimeter of the three dimensional element.

The "distance between a component of the blank and the midpoint of the longitudinal axis" is measured from a centre point of the component. The component may, for example, be the three dimensional element, and so reference may be made to a geometrical centre of the three dimensional element or to a geometrical centre of the affixing area. Similarly, the "distance between two components of the blank" is measured from respective centre points of the components. Thus, for example, the distance between the three dimensional element and a three dimensional patch member is measured between the centre point of the element and the centre point of the patch member.

The term "thickness" is used to describe the dimension of a three dimensional element, such as a radio frequency element, in a direction perpendicular to both the height and width of the element. When affixed to the container, the three dimensional element projects over a plane defined by the inner surface of the container comprising the affixing area by a height substantially corresponding to the element thickness.

With reference to a laminar blank from which a package or hinge-lid container may be formed, the term "thickness" identifies the distance between opposite inner and outer surfaces of the blank.

The expression "element having a discernible thickness" is used herein to refer to any three-dimensional element having a thickness from about 50 micrometres to about 500 micrometres. An example of one such element is a radio frequency identification (RFID) element.

It has been observed that affixing an element having a thickness less than about 50 micrometres to a blank for forming a container for consumer articles does not effectively cause issues relating to a reduced pliability of the blank, nor does it significantly impact the ease of stacking blanks or cause a compressive load to be applied on the consumer articles within the assembled container.

In some embodiments, the discernible thickness of the element is preferably at least about 50 micrometres, more preferably at least about 100 micrometres, even more preferably at least about 150 micrometres. In addition, or as an alternative, the discernible thickness is preferably less than about 500 micrometre, more preferably less than about 400 micrometres, even more preferably less than about 300 micrometres.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the container has an inner surface that is facing the inside of the container and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "hinge line" refers to a line about which the lid may be pivoted in order to open the hinge-lid housing. A hinge line may be, for example, a fold line or a score line in the panel forming the back wall of the container.

A container in accordance with the present invention is formed from a laminar blank having a blank thickness. The container comprises a three-dimensional element having a thickness in the range from about 50 micrometres to about 500 micrometres. This encompasses elements having a thickness substantially of the same order of magnitude of the thickness of blanks typically used for manufacturing containers for consumer articles. In contrast to existing containers, according to the present invention, the element is affixed to the container by means of adhesive provided on an affixing area of an inner surface of a first wall of the container, and the container further comprises a means for compensating for the thickness of the additional element. The thickness compensating means is provided in its entirety on a region of the inner surface of the container other than the affixing area. According to the present invention, a thickness compensating means is provided on the inner surface of the container at a location other than the affixing area, such that at said location the thickness of the container is increased by a predetermined amount so as to at least partly offset the impact of the three-dimensional element. It will be understood that, in order for this compensation to be effective, the thickness compensating means must not overlap the element of discernible thickness. Therefore, the entirety of the thickness compensating means extends in over a region of the inner surface of the container other than the affixing area. In other words, any portion of the inner surface of the container underlying the three-dimensional element does not also underlie the thickness-compensating means. Accordingly, in a region where the compensating means is provided, a local thickness of the container will substantially correspond to the sum of the blank thickness and the thickness of the thickness compensating means.

Thus, as will also be explained in more detail below, with containers in accordance with the present invention it is advantageously possible to at least partly offset or compensate the effects of the localised increase in thickness caused by the additional element of discernible thickness on a surface of the container. This advantageously contributes to even out the thickness non-homogeneity of the blank of the container.

Because the thickness of the blank for forming a container comprising the element of discernible thickness is made—on the average—more even, it is easier to stack a plurality of blanks on top of one another in a stable fashion, such that many blanks can be palletised and transported at once. Further, because the stacks of blanks for forming containers in accordance with the invention are more orderly and stable, it is also easier to feed such blanks to a packing machine, and so the manufacturing process is also made more reliable.

In addition, in containers according to the present invention the additional element is advantageously not visible from the outside during normal use of the container. Thus, at the same time, space on the external surface of the container may more effectively be used for branding or other printed information.

Finally, containers and blanks in accordance with the present invention are easy to manufacture and do not require any extensive modification of the existing apparatus.

The element affixed to the blank may be any three-dimensional element having a discernible thickness, that is, a thickness of an order of magnitude comparable with the thickness of the blank to which the element is attached. In preferred embodiments, the element is a radio frequency (identification) element, also commonly referred to as RFID tag. An RFID tag or other radio frequency element can store information relating to the product (for example, information relating to the identity and authenticity of the product). Typically, one such tag comprises an integrated circuit connected to an antenna or inductive coil. An RFID reader is used to interrogate the tag by transmitting a radio frequency signal which is received at the antenna or coil. In response to such signal, the RFID returns to the RFID reader a signal containing the information stored in the tag.

Preferably, the element is at a location along a longitudinal axis of the laminar blank, and a distance between the element and a midpoint of the longitudinal axis of the laminar blank is less than about 20 percent of a longitudinal dimension of the blank. Thus, containers in accordance with the present invention are effectively formed from blanks wherein the element of discernible thickness occupies a substantially central location. Not only is the element positioned on the longitudinal axis of the blank, but also it is ensured that the element is arranged within a central band of the blank surface extending on both sides of a mid-blank transverse axis. This is understood to be advantageous because the location of the element of discernible thickness on the longitudinal axis is in the vicinity of the centre of gravity of the blank. Accordingly, as will be explained in more detail below, blanks for forming containers in accordance with the present invention are particularly stable and easy to store and transport, as well as to supply to packing machines for being folded and formed into containers.

Without wishing to be bound to theory, it will be appreciated that the presence of an element of discernible thickness, such as a radio frequency element, affixed on a surface of the blank generally causes a local reduction in the pliability of the laminar substrate. In addition, because of the provision of the element of discernible thickness at a location on the surface of the blank, the surface of a blank for forming a container for consumer articles is not as even as is the case for conventional blanks. Thus, when two blanks including an element of discernible thickness are stacked on top of each other, the top one will tend to curve slightly to accommodate for the local additional thickness of the element on the bottom one. This effect will tend to propagate when a plurality of blanks are stacked on top of each other, as is the normally case when blanks for forming containers for consumer articles are stored, transported (for example, on pallets) or supplied to a packing machine for forming the containers.

The inventors have found that, where the element is at a location along a longitudinal axis of the laminar blank, and a distance between the element and a midpoint of the longitudinal axis of the laminar blank is less than about 20 percent of a longitudinal dimension of the blank, the undesirable effect described above is minimised, and stacks of blanks are particularly stable. This is understood to be because the localised curving of the blanks will generally occur at a location in the vicinity of the centre of gravity of the blanks, and at a position roughly defining a centre of symmetry of each blank. This makes the whole production process, from the storage and transportation phase to the actual manufacturing operation, significantly easier and more reliable.

In some embodiments, the thickness compensating means comprises a coating layer applied at least on a region of the inner surface of the first wall of the container extending about the affixing area, that is, around the element of discernible thickness. One such coating layer may comprise a varnish or an ultra-violet (UV) coating composition. One such composition may comprise one or more of several compounds known to the skilled reader for coating paper and cardboard, such as, for example, polyethylene, calcium carbonate and kaolinite. These compounds may be refined and mixed with viscosifiers to help them adhere to paper and cardboard. UV coatings can impart the paper or cardboard a gloss or matte finish.

In some embodiments, the coating layer may extend only to a finite portion of the inner surface of the first wall of the container extending about the affixing area. As an alternative, the coating layer may extend substantially to the whole inner surface of the first wall of the container extending about the affixing area.

In other embodiments, the coating layer may extend beyond the periphery of the first wall of the container, and even to the whole surface of the blank defining, in the assembled container, the inner surface of the container. This advantageously simplifies the manufacturing process, in that the coating layer may for example be applied substantially homogeneously over the whole blank surface prior to the debossing or ablating process.

Preferably, the coating layer has a thickness of at least about 70 percent of the element thickness. Thus, the coating layer compensates only in part the incremental thickness, yet one such degree of compensation has been found to be sufficient to make it easy to form a stable stack of blanks. More preferably, the coating layer has a thickness of at least about 80 percent of the element thickness. Even more preferably, the coating layer has a thickness of at least about 90 percent of the element thickness.

In particularly preferred embodiments, the coating layer has a thickness substantially equal to the element thickness. This is advantageous in that it substantially offsets the locally increased thickness in its entirety.

Preferably, the coating layer is removable. This is advantageous in that the need to compensate for the uneven surface of a blank comprising an additional element having a discernible thickness is felt especially when a plurality of blanks need to be stacked on one another, that is during storage and transportation. During such phases, the further layer may advantageously protect the surface of the laminar substrate during storage and transportation of the blanks. However, when feeding the blank comprising the additional element to a packing machine, it may instead be preferable to restore the original thickness of the laminar blank outside of the affixing area. This may be both for reasons to do with manufacturing requirements, for example set by the packing machine, as well as for ensuring that the assembled container has a certain visual impact, or to reduce the overall weight of the assembled container.

As an alternative to the coating layer, the thickness compensating means may comprise a three-dimensional patch member arranged on the inner surface of the container at a location other than the affixing region.

Preferably, the three dimensional patch is at a location along the longitudinal axis of the blank, and a distance between the element and the three dimensional patch is at least about 35 percent of a longitudinal dimension of the blank. Thus, an arrangement with a certain degree of symmetry is advantageously achieved, such that a centre of gravity of the unfolded blank is arranged substantially along a longitudinal axis of the blank, at a location between the element and the patch member. More preferably, a distance between the element and the three dimensional patch is at least about 40 percent of a longitudinal dimension of the blank, even more preferably at least about 45 percent of a longitudinal dimension of the blank.

Preferably, the patch member is arranged on the inner surface of a wall of the container other than the first wall. Even more preferably, the patch member is arranged on the inner surface of the wall of the container opposite the first wall. For example, where the element is affixed on the back wall, the patch member is affixed on the front wall.

By providing one such patch member on the same surface of the blank defining, in the assembled container, the inner surface of a wall, at least a partial reduction of the thickness non-homogeneity of the blank or container is achieved. For example, where the element is affixed on the inner surface of the back wall of the container, the compensating patch member is also affixed on the inner surface of the front wall of the container.

Preferably, a width of the patch member is less than a transverse dimension of the blank. In addition, or as an alternative, a height of the patch is preferably less than a longitudinal dimension of the blank panel on which the patch member is arranged. In preferred embodiments, the patch member has a shape and size comparable to the shape and size of the element of discernible thickness.

Preferably, the patch member has a thickness of at least about 70 percent of the element thickness. Thus, the patch member compensates only in part the incremental thickness. However, one such degree of compensation has been found to be sufficient to make it easy to form a stable stack of blanks. More preferably, the patch member has a thickness of at least about 80 percent of the element thickness. Even more preferably, the patch member has a thickness of at least about 90 percent of the element thickness. In some particularly preferred embodiments, the patch member has a thickness substantially equal to the element thickness. This is advantageous in that the element and the patch member, in combination, define a raised surface upon which another blank can lie in a state approximating a flat state.

Preferably, where the element is affixed on the first wall of the container, the patch member is arranged on the inner surface of another wall of the container, more preferably on a wall opposite the first wall. For example, where the element is affixed on the inner surface of the back wall of the container, the patch member is affixed on the inner surface of the front wall of the container. Thus, an arrangement with a certain degree of symmetry is advantageously achieved, wherein a centre of gravity of the blank is arranged substantially along a longitudinal axis of the blank, at a location between the element and the patch member. Thus, several blanks can still be quite easily stacked on top of each other, which is advantageous for storage, transportation, and for feeding the blanks to a packing machine.

Preferably, the patch member is removable. For example, the patch layer may be provided as a removable sticker. The term "removable" is used herein to describe a sticker attached to a surface by means of a generally low tack adhesive capable of forming a connection between two substrates—for example, between the patch member and the surface of the blank from which the container is formed—such that the two substrates can be separated from each other without causing any damage to either substrate.

In preferred embodiments, the container further comprises a reinforcing member comprising at least a front wall lying against an inner surface of the front wall of the container. In such embodiments, the element is preferably arranged in the affixing area on the container at a distance from a bottom edge of the front wall of the reinforcing member.

More preferably, a distance from a top edge of the element and the bottom edge of the reinforcing member is at least about 1 millimetre, even more preferably at least about 5 millimetres.

A container in accordance with the present invention may be formed by folding a blank for forming a container for consumer goods, the blank comprising a laminar substrate having a substrate thickness and a three dimensional element having a thickness of substantially the same order of magnitude of the substrate thickness, the element being affixed to the laminar substrate. The element is affixed to the substrate by means of adhesive provided on an affixing area of a first surface of the laminar substrate. In addition, the blank comprises a thickness compensating means on a region of the first surface of the laminar substrate other than the affixing area, the entirety of the thickness compensating means extending over a region of the first surface other than the affixing area.

When the container is assembled from the blank, the first surface of the blank to which the element is affixed faces the inside of the container. In other words, the additional element of discernible thickness is affixed on a side of a blank panel for forming a wall of the container, such that, in the assembled container, the additional element is affixed on the inner surface of said wall of the container.

Preferably, the element is at a location along a longitudinal axis of the laminar blank, and a distance between the element and a midpoint of the longitudinal axis of the laminar blank is less than about 20 percent of a longitudinal dimension of the blank. More preferably, the element is at a location along a longitudinal axis of the laminar blank, and a distance between the element and a midpoint of the longitudinal axis of the laminar blank is less than about 15 percent of the longitudinal dimension of the blank, even more preferably less than about 10 percent of the longitudinal dimension of the blank.

For example, in an embodiment the longitudinal dimension of the laminar blank is about 200 millimetres, the midpoint of the longitudinal axis is at about 100 millimetres from either end of the laminar blank, and the element of discernible thickness is located on the longitudinal axis at a distance of about 40 millimetres or less from the midpoint. More preferably, the element of discernible thickness is located on the longitudinal axis at a distance of about 30 millimetres or less from the midpoint. Even more preferably, the element of discernible thickness is located on the longitudinal axis at a distance of 20 millimetres or less from the midpoint.

In another embodiment, where the longitudinal dimension of the laminar substrate is about 250 millimetres, the midpoint of the longitudinal axis is at about 125 millimetres from either end of the laminar blank, and the element of discernible thickness is located on the longitudinal axis at a distance of about 50 millimetres or less from the midpoint. More preferably, the element of discernible thickness is located on the longitudinal axis at a distance of about 37.5 millimetres or less from the midpoint. Even more preferably, the element of discernible thickness is located on the longitudinal axis at a distance of 25 millimetres or less from the midpoint.

In some embodiments, the thickness compensating means comprises a coating layer applied at least on a region of the first surface of the laminar substrate extending about the affixing area. As an alternative, the thickness compensating means may comprise a three-dimensional patch member arranged on the first surface of the laminar substrate at a location other than the affixing region.

Preferably, the consumer goods in the container are bundled together and wrapped in a package of metal foil or metallised paper. The package material may be formed as a laminate of a metallised polyethylene film, and a liner material. The package material may also be a supercalendered glassine paper. In addition, the package material may be provided with a print-receptive top coating.

One such package may be received within a hinge lid container comprising a box and a lid hinged to the box along a hinge line extending across a back wall of the hinge lid container. The hinge lid container may be formed from a laminar blank of any suitable material or combination of materials, including, but not limited to, cardboard, paperboard, plastic, metal, or combinations thereof. Preferably, the blank is a laminar cardboard blank having a weight of between about 100 grams per square metre and about 350 grams per square metre.

The hinge-lid container may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

The package, as well as the outer hinge lid container, is preferably a rectangular parallelepiped comprising two wider walls spaced apart by two narrower walls.

Containers according to the invention find particular application as containers for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles. The smoking articles may be arranged in different collations, depending on the total number of smoking articles.

The invention will now be further described, by way of example only, with reference to the accompanying drawings in which.

Figure 1:
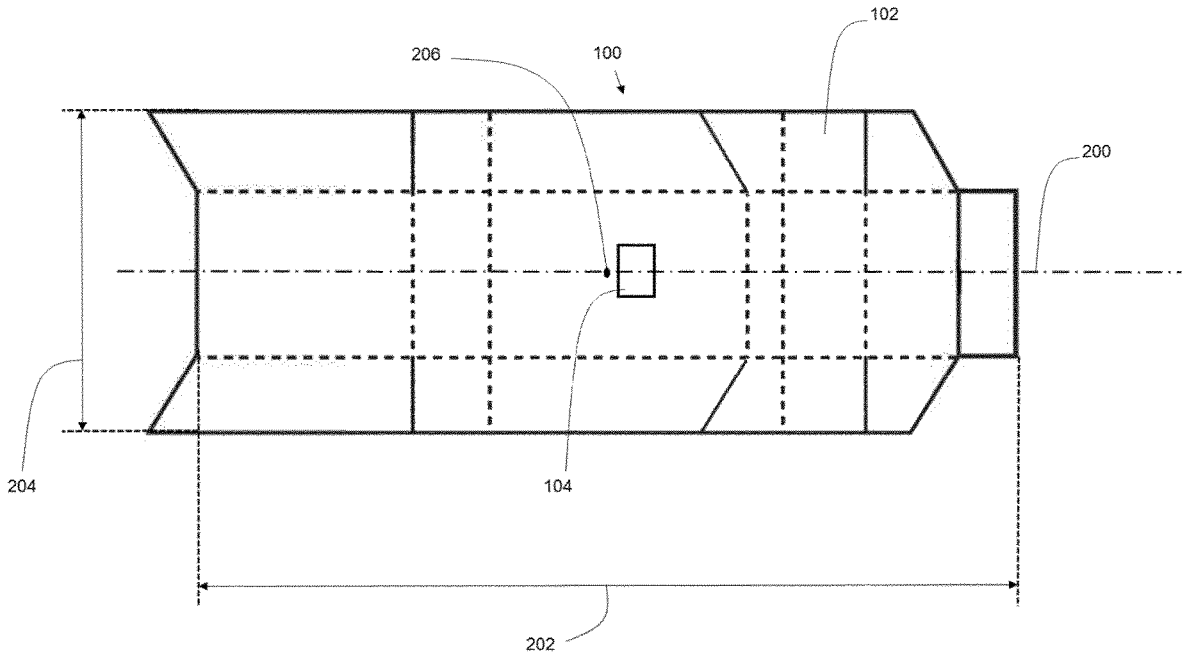
FIG. 1 is a schematic top view of a blank for forming a container in accordance with the present invention.
Figure 2:
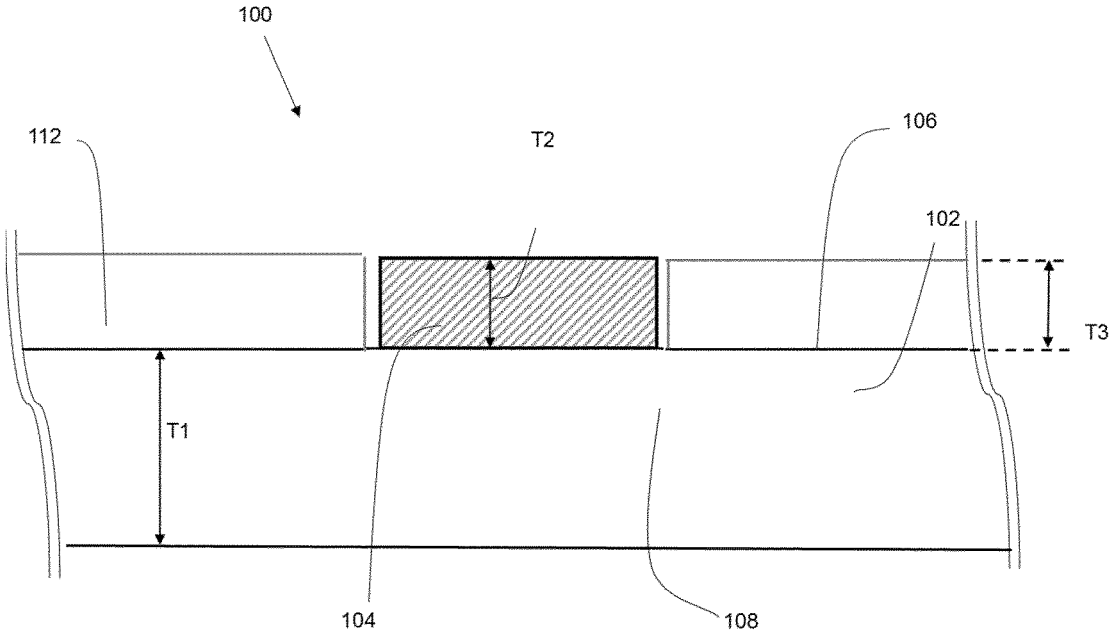
FIG. 2 is a schematic side sectional view of a detail of the blank of FIG. 1.

A container according to the present invention may be formed from the laminar blank 100 shown in FIG. 1. In more detail, the laminar blank 100 of FIG. 1 is for forming a parallelepiped hinge lid container of the type commonly used for housing smoking articles, such as filtered cigarettes. The laminar blank 100 may be assembled and filled using standard apparatus. FIG. 2 shows a sectional view of a detail of the blank 100 of FIG. 1.

The blank 100 comprises a laminar substrate 102 having a thickness T1 of about 320 micrometres. The laminar substrate 102 has a longitudinal axis 200, a longitudinal dimension 202 and a transverse dimension 204. Further, the blank 100 comprises a parallelepiped shaped element 104 having a thickness T2 of about 200 micrometres. As shown in FIG. 2, the element 104 is affixed to the laminar substrate 102 by means of adhesive provided on an affixing area 106 of a first surface 108 of the laminar substrate 102. When a container is formed from the laminar blank 100, the first surface 108 faces the inside of the container.

As illustrated in FIG. 1, the element 104 is at a location along the longitudinal axis 200 of the laminar substrate 102, and a distance between the element 104 and a midpoint 206 of the longitudinal axis 200 of the laminar substrate is less than about 15 percent of the longitudinal dimension 202 of the laminar substrate 102. In more detail, the element 104 comprises a radio frequency element and is shaped symmetrical with respect to the longitudinal axis 200. The longitudinal dimension 202 of the laminar substrate is about 250 millimetres. The midpoint 206 of the longitudinal axis is at about 125 millimetres from either end of the laminar substrate. The distance between the element 104 and the midpoint 206 is about 12 millimetres (10 percent of the longitudinal dimension of the laminar substrate amounting to about 25 millimetres).

As shown in FIG. 2, the blank 100 comprises a further layer 112 comprising a varnish on a region of the first surface 108 of the laminar substrate 102 extending about the affixing area 108. In the embodiment illustrated in FIG. 2, a thickness T3 of the further layer 112 is substantially as great as the element thickness T2. Thus, the further layer advantageously compensates for the entirety of the element thickness. The further layer 112 is removed from the laminar substrate 102 immediately prior to feeding the blank 100 to a packing machine for forming a container.

Figure 3:
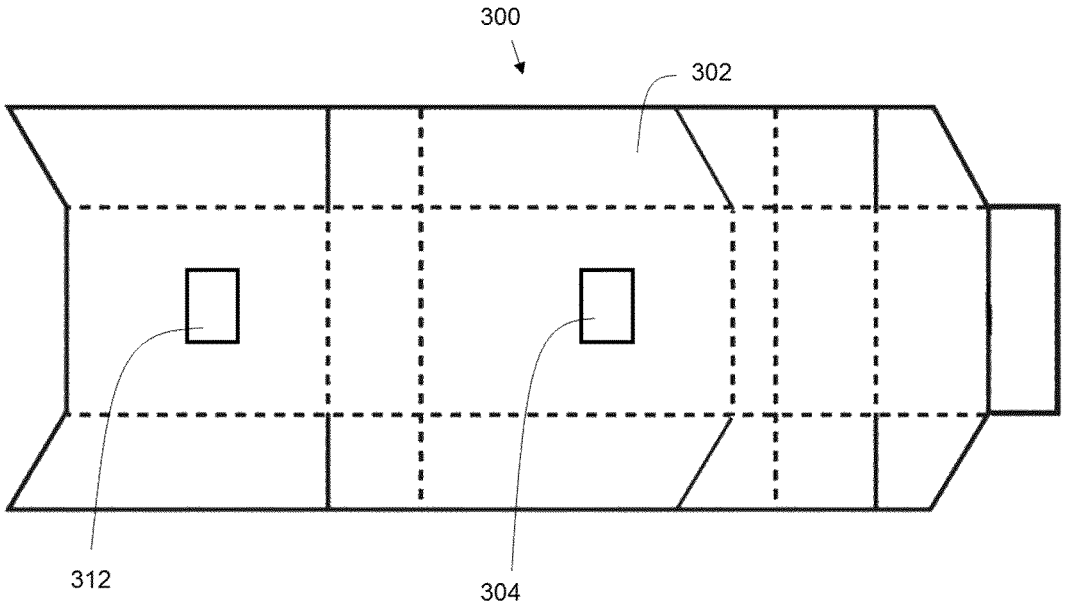
FIG. 3 is a schematic top view of a variant of a blank for forming a container in accordance with the present invention.

FIG. 3 shows a variant of a blank 300 for forming a container for consumer articles in accordance with the present invention. The blank 300 comprises a laminar substrate 302 and a parallelepiped element of discernible thickness 304, the element 304 being affixed to and received into an affixing area of a first surface of the blank 300.

The blank 300 differs from the blank 100 of FIGS. 1 and 2 in that, instead of a further layer extending about the affixing area, it comprises a thickness compensating member in the form of a three-dimensional patch member 312 arranged on the first surface of the laminar substrate at a location other than the affixing region.

The invention claimed is:

1. A container for consumer goods, the container being formed from a laminar blank having a blank thickness; the container comprising a three dimensional element having a thickness from about 50 micrometres to about 500 micrometres, wherein the three dimensional element is affixed to the container by adhesive provided on an affixing area of an inner surface of a first wall of the container; and wherein the container comprises a thickness element for at least partly offsetting or compensating the thickness of the three dimensional element, the thickness element provided in its entirety on a region of the inner surface of the container other than the affixing area, wherein the thickness element increases the thickness of the container at the region in which the thickness element is provided.

2. The container of claim 1, wherein the three dimensional element is at a location along a longitudinal axis of the laminar blank, and a distance between the three dimensional element and a midpoint of the longitudinal axis of the laminar blank is less than about 20 percent of a longitudinal dimension of the blank.

3. The container of claim 1, wherein the thickness element comprises a coating layer applied at least on a region of the inner surface of the first wall of the container extending about the affixing area.

4. The container of claim 1, wherein the thickness element comprises a three-dimensional patch member arranged on the inner surface of the container at a location other than the affixing area.

5. The container of claim 4, wherein the three dimensional patch member is at a location along the longitudinal axis of the blank, and a distance between the three dimensional element and the three dimensional patch is at least about 35 percent of a longitudinal dimension of the blank.

6. The container of claim 4, wherein the three dimensional patch member is arranged on the inner surface of a wall of the container opposite the first wall.

7. The container of claim 1, wherein the thickness element has a thickness of at least about 70 percent of the thickness of the three dimensional element.

8. The container of claim 1, wherein the thickness element has a thickness substantially equal to the thickness of the three dimensional element.

9. The container of claim 1, wherein the thickness element is removable.

10. The container of claim 1, further comprising a reinforcing member comprising at least a front wall lying against an inner surface of the front wall of the container, wherein the three dimensional element is affixed to the container at a distance from a bottom edge of the front wall of the reinforcing member.

11. The container of claim 1 wherein the consumer goods are smoking articles.

12. A blank for forming a container for consumer goods, the blank comprising a laminar substrate having a substrate thickness and a three dimensional element having a thickness from about 50 micrometres to about 500 micrometres, the three dimensional element being affixed to the laminar substrate;

wherein the three dimensional element is affixed to the blank by adhesive provided on an affixing area of a first surface of the laminar substrate; and wherein the blank comprises a thickness element for at least partly offsetting or compensating the thickness of the three dimensional element, the thickness element being provided on a region of the first surface of the laminar substrate other than the affixing area, the entirety of the thickness element extending over a region of the first surface other than the affixing area, wherein the thickness element increases the thickness of the container at the region in which the thickness element is provided.

13. The blank of claim 12, wherein the three dimensional element is at a location along a longitudinal axis of the laminar blank, and a distance between the element and a midpoint of the longitudinal axis of the laminar blank is less than about 20 percent of a longitudinal dimension of the blank.

14. The blank of claim 12, wherein the thickness element comprises a coating layer applied at least on a region of the first surface of the laminar substrate extending about the affixing area.

15. The blank of claim 12, wherein the thickness element comprises a three-dimensional patch member arranged on the first surface of the laminar substrate at a location other than the affixing region.

* * * * *